US006925678B2

(12) United States Patent
Libman et al.

(10) Patent No.: US 6,925,678 B2
(45) Date of Patent: Aug. 9, 2005

(54) DUST PAN WITH MULTIPLE HANDLE OPTIONS

(75) Inventors: Robert J. Libman, Champaign, IL (US); Fernando Santos, Maceira-Lis (PT)

(73) Assignee: The Libman Company, Arcola, IL (US)

( * ) Notice: Subject to any disclaimer, the term of this patent is extended or adjusted under 35 U.S.C. 154(b) by 0 days.

(21) Appl. No.: 10/650,868

(22) Filed: Aug. 28, 2003

(65) Prior Publication Data

US 2005/0044652 A1 Mar. 3, 2005

(51) Int. Cl.[7] ..... A47L 13/52
(52) U.S. Cl. ..... 15/257.7; 15/257.1
(58) Field of Search ..... 15/257.1, 257.2, 15/257.7, 257.9; D32/74

(56) References Cited

U.S. PATENT DOCUMENTS 3,002,209 A * 10/1961 McKinstry ..... 15/1
4,050,110 A * 9/1977 Donnelly ..... 15/105
D345,238 S 3/1994 Berti
D347,915 S 6/1994 Berti
5,473,790 A * 12/1995 Desmarais ..... 15/257.7
5,826,297 A * 10/1998 Footer et al. ..... 15/257.2
6,223,386 B1 * 5/2001 Morad ..... 15/257.1

* cited by examiner

*Primary Examiner*—John Kim
*Assistant Examiner*—Laura C Cole
(74) *Attorney, Agent, or Firm*—Banner & Witcoff, Ltd.

(57) ABSTRACT

A dust pan has both an elongate handle and a receptacle for a removable long handle. The elongate handle may be unitary with and extend rearwardly from a back wall on the dust pan. The receptacle may be disposed along an upright back wall of the dust pan, and may include a set of internal thread segments beneath an extended channel, enabling the receptacle to accommodate either a threaded ¾" diameter handle, or a 1" diameter handle.

10 Claims, 10 Drawing Sheets

DUST PAN WITH MULTIPLE HANDLE OPTIONS

BACKGROUND OF THE INVENTION

The present invention relates generally to cleaning tools, and more particularly to dust pans.

Dust pans are used for picking up debris. They generally have a handle. Dust pans with short handles are easy to empty and to store, but can be wearisome to use because moving from location to location requires the user to bend to the floor to pick up the pan. Long handles may help to minimize the need for bending as the pan is moved to different locations, but can make it inconvenient to empty and to store the dust pan.

BRIEF DESCRIPTIONS OF THE INVENTION

A convenient new dust pan has been developed. The handle arrangement of the product combines the ease of storage and emptying of a dust pan having a conventional short handle, with the ease of moving of a dust pan having a long handle.

A dust pan in accordance with the present invention includes both an elongate handle and a receptacle for a removable long handle. Preferably, the elongate handle is unitary with and extends rearwardly from a back wall on the dust pan.

Preferably, the receptacle is disposed along an upright back wall on a pan section on the dust pan and includes a set of internal thread segments beneath an extended channel, the sides of which can serve to engage and support the removable handle.

The elongate handle may be U-shaped, and a mounting aperture can be provided for easy storage.

BRIEF DESCRIPTION OF THE DRAWINGS

The invention may be better understood by referring to the accompanying drawings, in which.

DETAILED DESCRIPTION OF THE DRAWINGS

Figure 1:
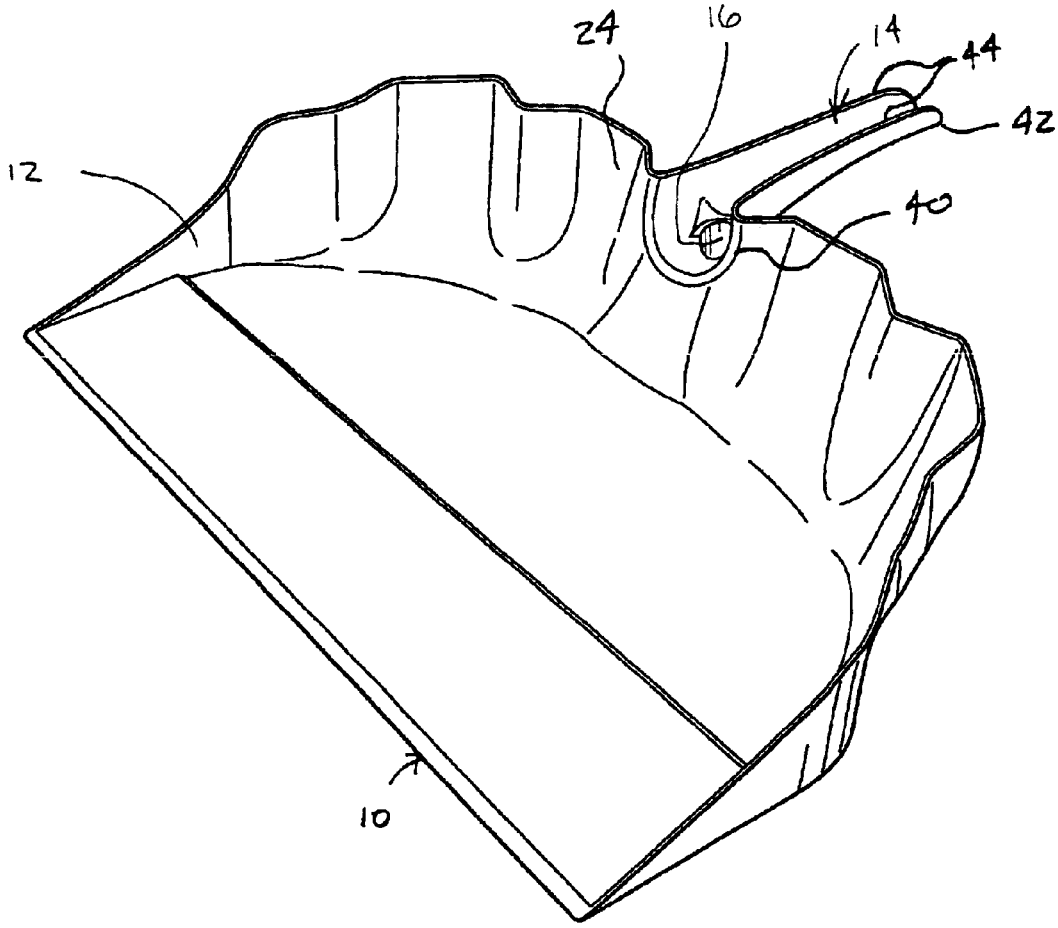
FIGS. 1 and 2 are perspective views of a dust pan in accordance with one embodiment of the invention.

FIGS. 1–7 show one embodiment of a dust pan 10 in accordance with the present invention. The dust pan includes a pan section 12, an elongate handle 14, and a receptacle 16 for a removable handle 18 (seen in FIGS. 9 and 10).

Figure 2:
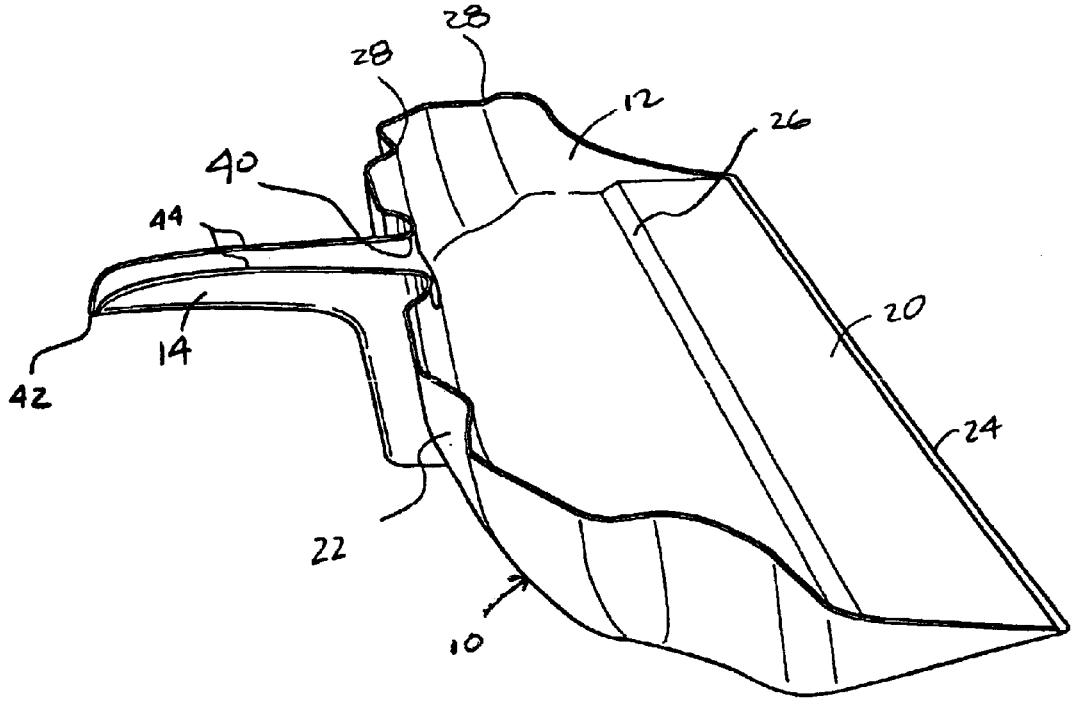
Figure 3:
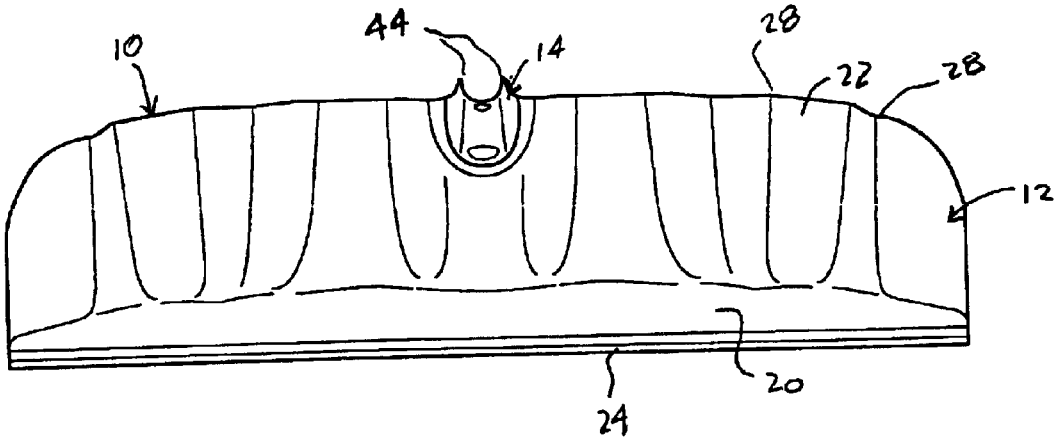
FIGS. 3–7 are front, back, side, top, and bottom views of the dust pan seen in FIGS. 1 and 2.
Figure 4:
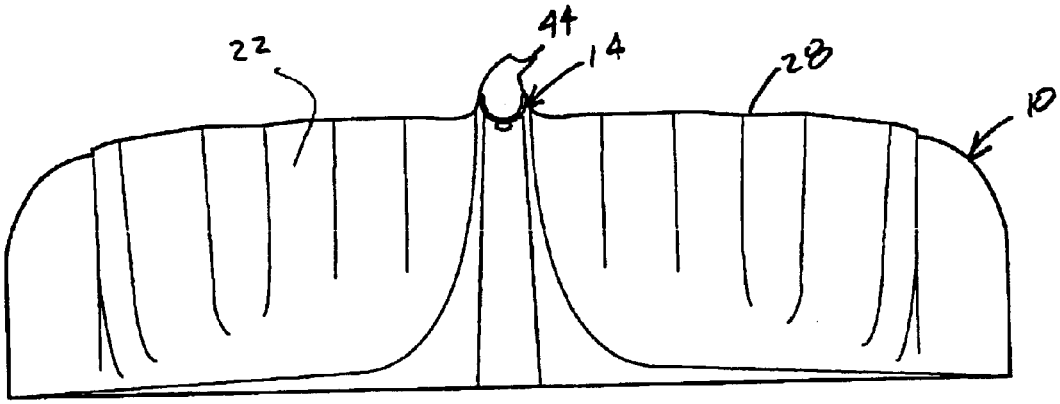

As seen in FIGS. 2 and 3, the pan section 12 of the dust pan 10 includes a base 20 and an upright back wall 22. In the embodiment of the invention that has been illustrated, the base has a front edge 24, is made of molded ⅛" thick plastic, and is approximately 20" wide and about 11" deep. The base includes a ½" high slanted ledge 26, best seen in FIG. 2, that may help to strengthen the base and to keep swept debris in the dust pan. The back wall is molded integrally with the base, and rises approximately 5" above the base. It includes corrugations 28 that may provide improved rigidity and strength. These dimensions are not critical to the invention.

Figure 5:
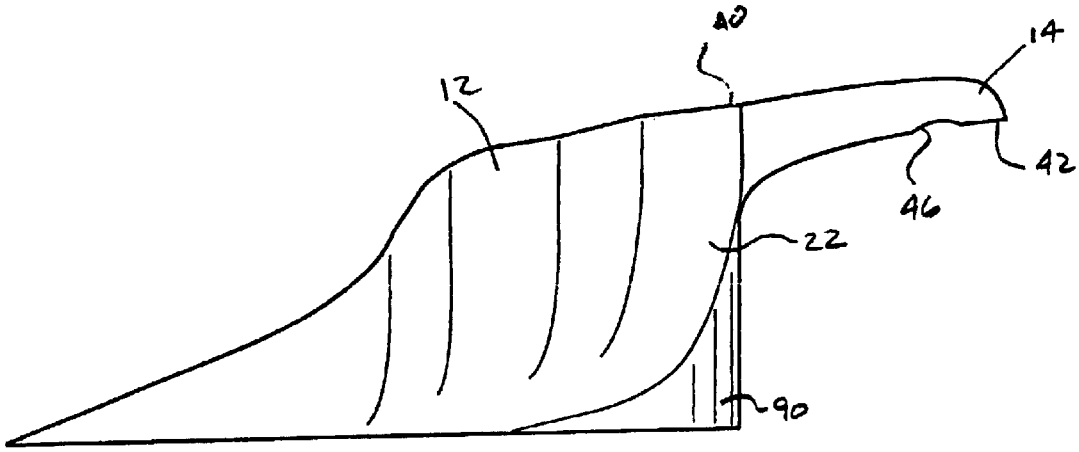
Figure 6:
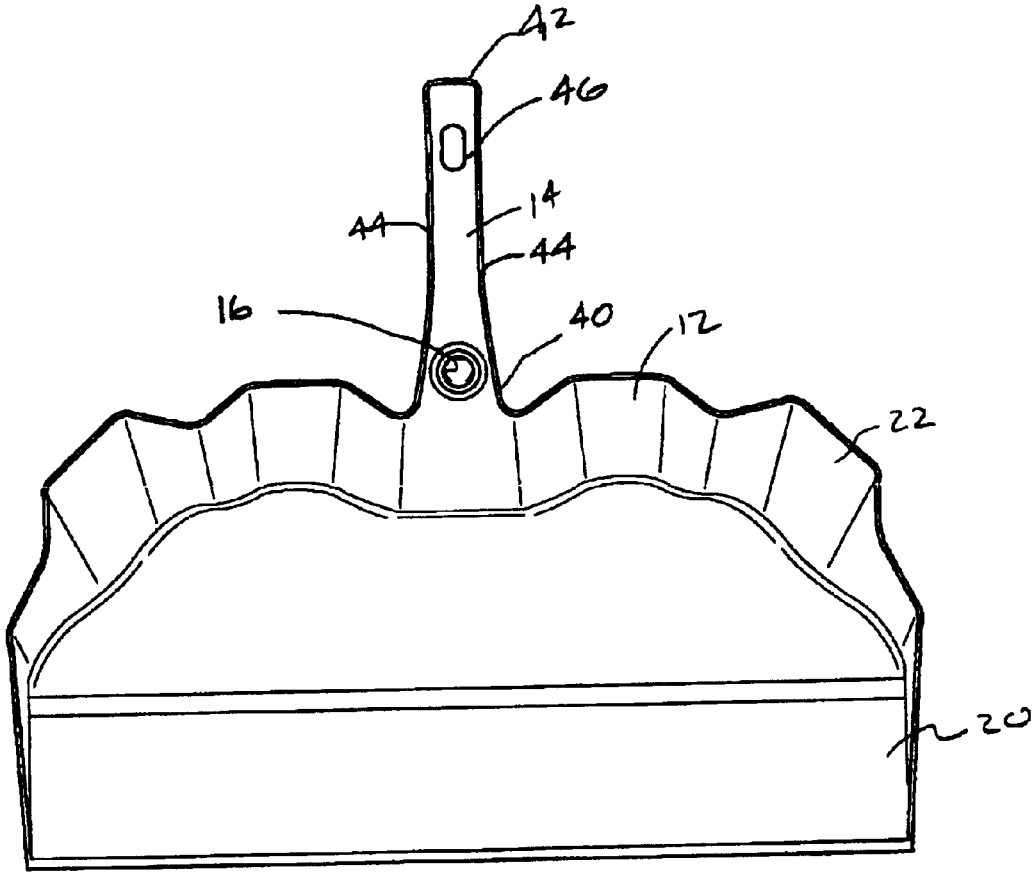
Figure 7:
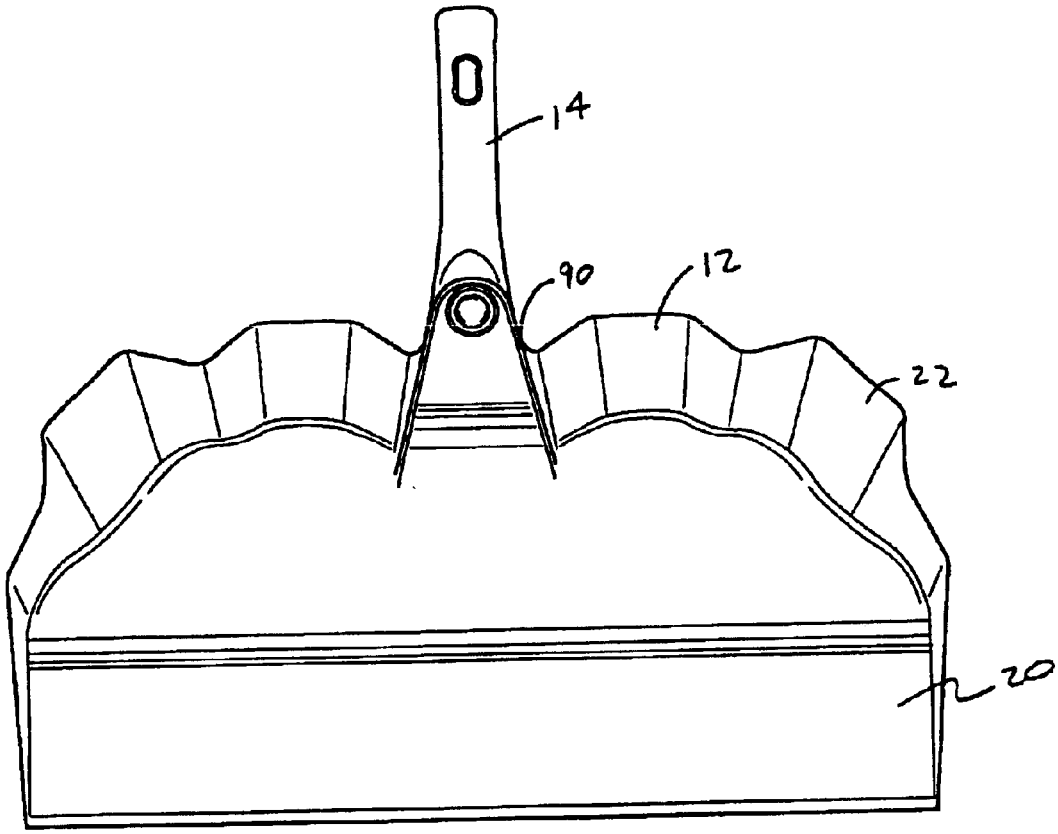

Preferably, the elongate handle 14, best seen in FIGS. 5–7, has a U-shaped cross-section and, for strength and manufacturing ease, is molded integrally with the pan section 12. In the embodiment of the invention that has been illustrated, the elongate handle 14 is approximately 1" high, extends rearwardly from an inner end 40 near the top of the center of the back wall 22 to an outer end 42. The illustrated elongate handle has a U-shaped cross-section with sides 44 that are about 2" apart near the inner end and about 1" apart near the outer end of the elongate handle. While the shape of the elongate handle is not critical, the illustrated U-shaped cross-section provides a comfortable grip and may help to strengthen the handle while minimizing the amount of material used, thus reducing manufacturing cost and product weight. A 1" by ½" mounting aperture 46 can be provided near the outer end of the handle to facilitate hanging the dust pan 10 from a hanger.

Figure 8:
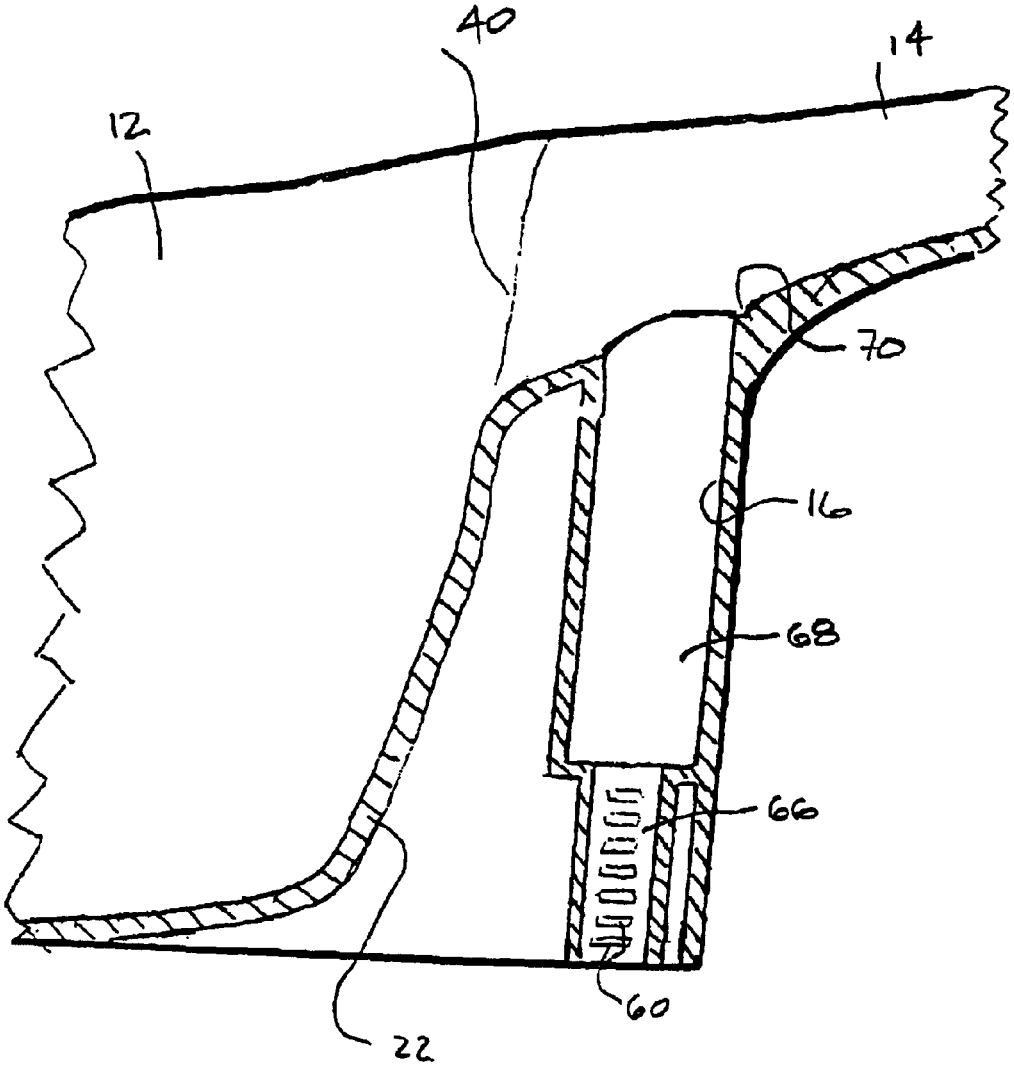
FIG. 8 is an enlarged sectional view of the receptacle section of the dust pan seen in FIGS. 1–7.
Figure 9:
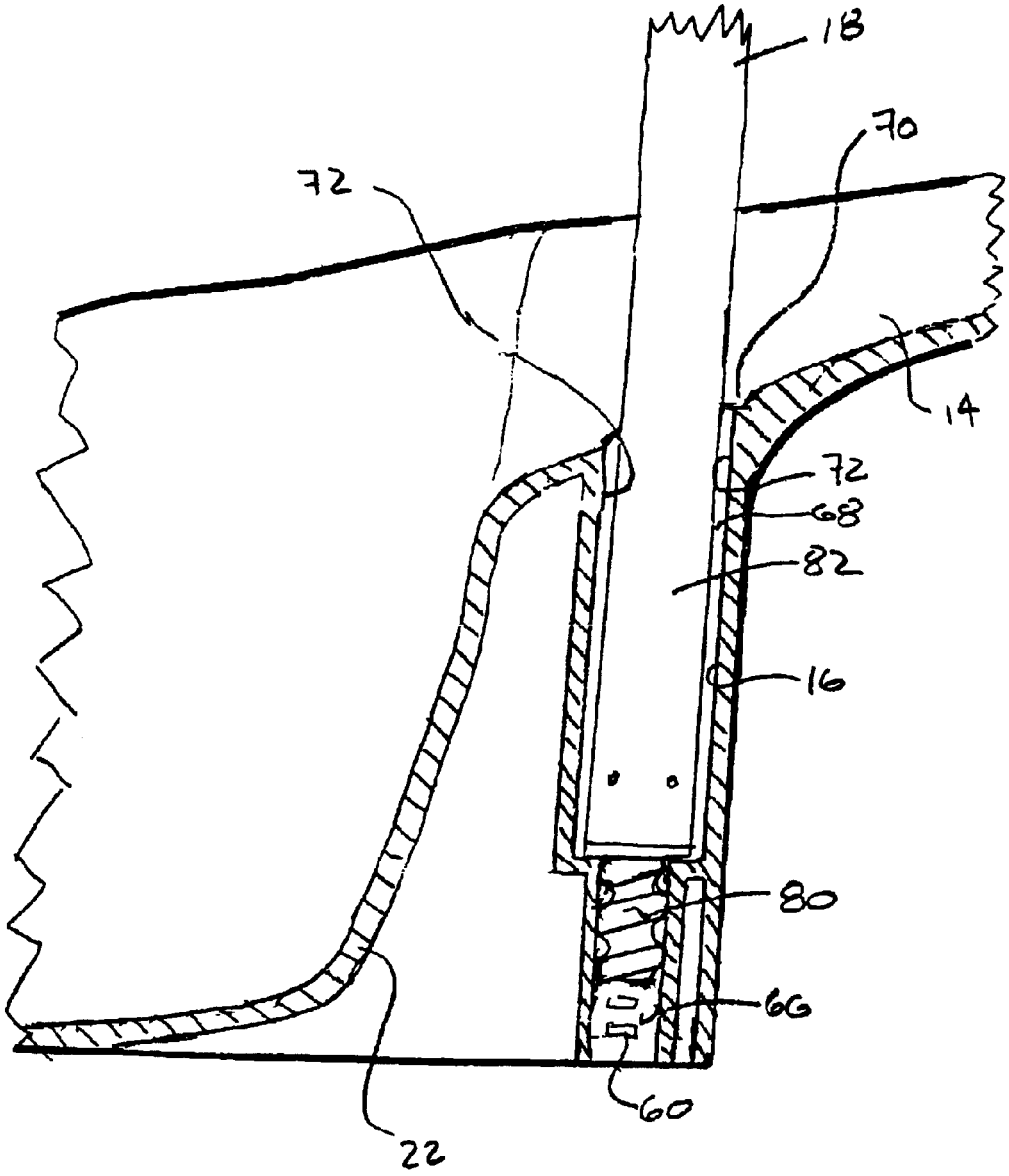
FIGS. 9 and 10 are enlarged sectional views corresponding to FIG. 8, in each of which a different embodiment of a removable handle has been added.
Figure 10:
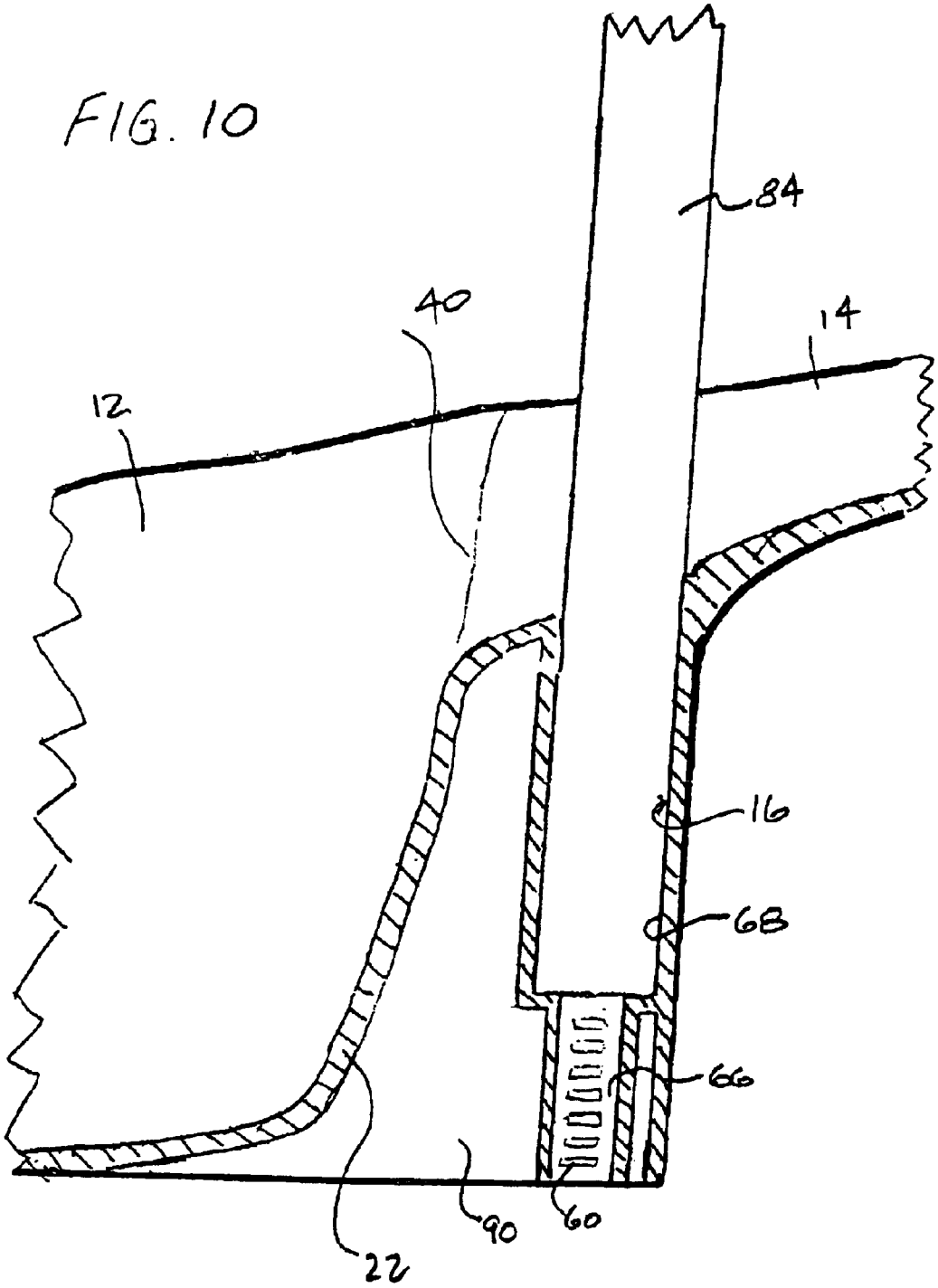

As seen in FIGS. 8–10, the receptacle 16 for the removable handle 18 can include internal thread segments 60. As seen in FIG. 9, the illustrated thread segments accommodate a conventional threaded section 80 on a ¾" diameter handle 82. In the illustrated embodiment of the invention, the thread segments are arranged on a lower receptacle section 66 that is about 1" high. There is a coaxial extended channel 68 that extends alongside the back wall 22 of the pan section 12 from the lower receptacle section to a junction 70 with a part of the inner end 40 of the elongate handle 14. The illustrated extended channel is approximately 3" high, with a relatively large diameter of approximately 1" compared to the smaller diameter of the lower receptacle section 66.

In the embodiment of the invention seen in FIG. 9, the wall segments 72 on the extended channel 68 are disposed well above the thread segments 60 (at least about 1" above them). This arrangement helps to support the connection between the ¾" handle 82 and the receptacle 16 against stresses that may otherwise accumulate at the joint when the dust pan is used. In order to provide such support, it is preferred that the wall segments be at least about ½" high, and be disposed at least about 1" above the thread segments.

The added height of the illustrated extended channel 68 also adapts it to receive and support a compression-fit 1" diameter handle 84, as seen in FIG. 10. Thus, the illustrated receptacle 16 can accommodate handles of different types, and can be viewed as a "universal" receptacle.

Arranging the receptacle 16 along the back wall 22 of the pan section 12 improves the design. For strength, reinforcement 90 can be wrapped around the receptacle, as seen in FIG. 7, securing the receptacle to the pan section 12. In the illustrated embodiment of the invention, the reinforcement is molded integrally with the pan section.

This description of a few embodiments of the invention has been provided merely for illustrative purposes. The scope of the invention is set forth in the following claims.

What is claimed is:

1. A dust pan comprising:

a pan section having an upright rear wall;

an elongate handle extending rearwardly from the pan section, the elongate handle being unitary with the pan section and having an inner end adjacent the rear wall; and a receptacle for a removable handle, the receptacle disposed along the rear wall and having an inner channel extending downwardly from the inner end of the elongate handle and along the rear wall.

2. A dust pan as recited in claim 1, in which the receptacle is adapted to receive either a ¾"-diameter threaded handle or a 1"-diameter handle.

3. A dust pan as recited in claim 1, in which the elongate handle has a U-shaped cross-section.

4. A dust pan as recited in claim 1, in which the receptacle comprises a set of internal thread segments.

5. A dust pan as recited in claim 1, in which the receptacle comprises thread segments that are disposed beneath the inner channel.

6. A dust pan as recited in claim 1, in which the receptacle comprises thread segments and wall segments above the thread segments, the wall segments being configured to support the removable handle at a distance at least about one inch above the thread segments.

7. A dust pan as recited in claim 1, in which the inner channel has a relatively large diameter and a lower receptacle section that has a relatively small diameter, the inner channel and the lower receptacle section each being at least about ½" in height.

8. A dust pan as recited in claim 1, and further comprising a removable handle.

9. A dust pan as recited in claim 1, wherein the inner channel is adaptable to receive a first removable handle having a first diameter and a second removable handle having a second diameter.

10. A dust pan as recited in claim 1, further comprising a stabilizing portion about the receptacle.

* * * * *